US009576537B2

(12) United States Patent
Kwon et al.

(10) Patent No.: US 9,576,537 B2
(45) Date of Patent: Feb. 21, 2017

(54) DISPLAY APPARATUS

(71) Applicant: Samsung Display Co., Ltd., Yongin, Gyeonggi-do (KR)

(72) Inventors: Junghyun Kwon, Seoul (KR); Jae Byung Park, Seoul (KR); Jong Hyuk Kang, Suwon-si (KR); Dong-Hoon Lee, Hwaseong-si (KR); Hyundeok Im, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 517 days.

(21) Appl. No.: 13/971,175

(22) Filed: Aug. 20, 2013

(65) Prior Publication Data

US 2014/0268633 A1 Sep. 18, 2014

(30) Foreign Application Priority Data

Mar. 15, 2013 (KR) ..... 10-2013-0027929

(51) Int. Cl.
*G09G 3/34* (2006.01)
*G09G 3/20* (2006.01)

(52) U.S. Cl.
CPC ..... *G09G 3/3406* (2013.01); *G09G 3/2025* (2013.01); *G09G 2300/0452* (2013.01); *G09G 2300/0456* (2013.01); *G09G 2340/06* (2013.01)

(58) Field of Classification Search
CPC ..... G02F 1/133308; G02F 1/133615; G02B 6/0085; G02B 6/009; G09G 3/3648; G09G 3/3406; G09G 3/2025;G09G 2300/0456; G09G 2300/0452; G09G 2340/06
See application file for complete search history.

(56) References Cited

U.S. PATENT DOCUMENTS

| | | | | |
|---|---|---|---|---|
| 6,501,091 | B1 | 12/2002 | Bawendi et al. | |
| 7,857,458 | B2 | 12/2010 | Fujita et al. | |
| 7,952,544 | B2 | 5/2011 | Roberts | |
| 2001/0028053 | A1 | 10/2001 | Hohn et al. | |
| 2005/0276995 | A1* | 12/2005 | Kondo et al. | 428/690 |
| 2008/0128735 | A1* | 6/2008 | Yoo et al. | 257/98 |
| 2008/0224973 | A1* | 9/2008 | Louwsma | G09G 3/342 345/88 |
| 2011/0267381 | A1* | 11/2011 | Yamazaki et al. | 345/690 |
| 2012/0162283 | A1 | 6/2012 | Miyairi et al. | |
| 2013/0300771 | A1 | 11/2013 | Cho et al. | |

FOREIGN PATENT DOCUMENTS

| | | | |
|---|---|---|---|
| JP | 2003-280614 | A | 10/2003 |
| KR | 1020070115184 | A | 12/2007 |
| KR | 1020080002301 | A | 1/2008 |
| KR | 1020080043431 | A | 5/2008 |

* cited by examiner

*Primary Examiner* — Diane Lee
*Assistant Examiner* — Danielle Allen
(74) *Attorney, Agent, or Firm* — Cantor Colburn LLP

(57) ABSTRACT

A display apparatus includes a display panel including a plurality of pixels, and a backlight unit disposed at a rear surface of the display panel and supplying a light to the display panel, where the backlight unit includes a first light source which provides a first color light to the display panel, a second light source which provides a second color light to the display panel, and a third light sources which provides a third color light to the display panel, spectral bands of the first, second and third color light are different from each other, and the first color light and the second color light have substantially the same color as each other.

16 Claims, 20 Drawing Sheets

< 1-Field >

< 1-Field >

< 2-Field >

< 3-Field >

< 2-Field >

< 3-Field >

< 1-Field >

< 2-Field >

< 3-Field >

< 2-Field >

< 3-Field >

DISPLAY APPARATUS

This application claims priority to Korean Patent Application No. 10-2013-0027929, filed on Mar. 15, 2013, and all the benefits accruing therefrom under 35 U.S.C. §119, the content of which in its entirety is herein incorporated by reference.

BACKGROUND

1. Field

The disclosure relates to a display apparatus. More particularly, the disclosure relates to a display apparatus with improved display quality.

2. Description of the Related Art

A display apparatus may display a full color image using a space division scheme. Such a display apparatus may include a display panel including red, green and blue color filters repeatedly arranged to correspond to sub-pixels in a one-to-one correspondence. In such a display apparatus, a combination of the red, green and blue color filters define a unit to realize a color, and the full color image is realized by transmittance difference between the sub-pixels of the display panel and the color combination of the red, green and blue color filters. As described above, an arrangement in which the red, green and blue color filters are arranged in different spaces is called the space division scheme.

A display apparatus may display a full color image using a time division scheme (or a field sequential scheme). In such a display apparatus, the color filters may be omitted from the display panel and a backlight unit disposed at a rear side of the display panel includes red, green and blue light sources that emit red, green and blue color light, respectively. In such a display apparatus, a frame may be divided into three fields timely separated from each other, and the red, green and blue light sources are sequentially turned on in each field, thereby sequentially displaying red, green and blue color images. Accordingly, an observer perceives the full color image obtained by combining the red, green and blue color images by a physiological visual sensation.

SUMMARY

The disclosure relates to a display apparatus with reduced color breakup and improved color reproducibility.

An exemplary embodiment of a display apparatus includes a display panel including a plurality of pixels, and a backlight unit disposed at a rear surface of the display panel and supplying a light to the display panel, where the backlight unit includes a first light source which provides a first color light to the display panel, a second light source which provides a second color light to the display panel, and a third light sources which provides a third color light to the display panel, spectral bands of the first, second and third color light are different from each other, and the first color light and the second color light have substantially the same color as each other.

In an exemplary embodiment, each of the first color light and the second color light may be a yellow color light.

In an exemplary embodiment, the third color light may be a blue color light.

In an exemplary embodiment, a spectrum of the first light may have a peak in a spectral band corresponding to the yellow color light.

In an exemplary embodiment, a spectrum of the second light may have peaks in spectral bands corresponding to a red color light and a green color light.

In an exemplary embodiment, the display panel may display an image in a unit of frame, each frame may include first, second and third sub-fields, and the backlight unit may provide the first to third color light during the first, second and third sub-fields, respectively.

In an exemplary embodiment, each of the pixels may include a first color filter, a second color filter having a color different from the first color filter, and an open portion defined outside of the first and second color filters, a first sub-pixel corresponding to the first color filter, a second sub-pixels corresponding to the second color filter, and a third sub-pixel corresponding to the open portion, where the first to third sub-pixels may operate independently of each other.

In an exemplary embodiment, the first color filter may include a red color filter having a red color, and the second color filter may include a green color filter having a green color.

In an exemplary embodiment, the first and second sub-pixels may receive the first color light during the first sub-field, the third sub-pixel may receive the second color light during the second sub-field, and the third sub-pixel may receive the third color light during the third sub-field.

In an exemplary embodiment, the first to third sub-pixels may receive the first color light during the first sub-field, the first to third sub-pixels may receive the second color light during the second sub-field, and the third sub-pixel may receive the third color light during the third sub-field.

According to exemplary embodiments, the display apparatus effectively prevents the color breakup phenomenon, and the color reproducibility of the display apparatus is substantially improved.

BRIEF DESCRIPTION OF THE DRAWINGS

The above and other feature of the invention will become readily apparent by reference to the following detailed description when considered in conjunction with the accompanying drawings, in which.

DETAILED DESCRIPTION

Figure 1:
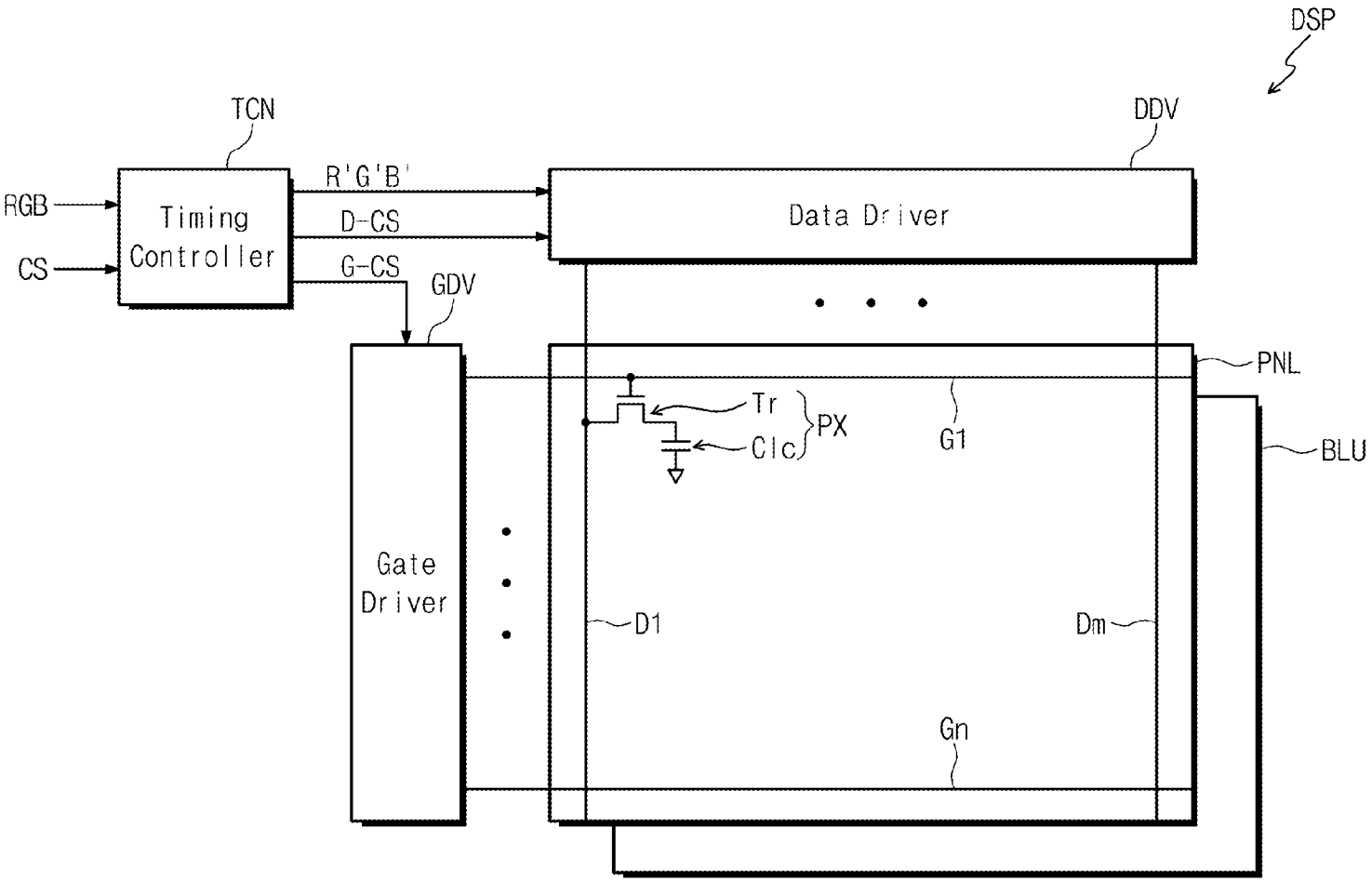
FIG. 1 is a block diagram showing an exemplary embodiment of a display apparatus according to the invention.

The invention will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

Hereinafter, exemplary embodiments of the invention will be described in detail with reference to the accompanying drawings.

FIG. 1 is a block diagram showing an exemplary embodiment of a display apparatus according to the invention.

Referring to FIG. 1, a display apparatus DSP includes a display panel PNL that displays an image, gate and data drivers GDV and DDV that drive the display panel PNL, and a timing controller TCN that controls the gate and data drivers GDV and DDV.

In an exemplary embodiment, the display panel PNL is a non-emissive display panel, e.g., a liquid crystal display panel, but not being limited thereto. In an alternative exemplary embodiment, the display panel PNL may be an electrophoretic display panel, an electrowetting display panel, or a microelectromechanical system ("MEMS") display panel.

The display panel PNL includes a plurality of gate lines G1 to Gn, a plurality of data lines D1 to Dm, and a plurality of pixels PX arranged substantially in a matrix form. The gate lines G1 to Gn extend substantially in a row direction, and are arranged substantially in a column direction and substantially parallel to each other. The data lines D1 to Dm extend substantially in a column direction, and are arranged substantially in the row direction and substantially parallel to each other.

Each pixel PX includes a thin film transistor and a liquid crystal capacitor. In one exemplary embodiment, for instance, a pixel PX connected to a first gate line G1 and a first data line D1 includes the thin film transistor Tr and the liquid crystal capacitor Clc.

The thin film transistor Tr of the pixel PX includes a gate electrode connected to the first gate line G1, a source electrode connected to the first data line D1, and a drain electrode connected to the liquid crystal capacitor Clc.

The timing controller TCN receives image signals RGB and control signals CS from an outside of the display apparatus DSP. The timing controller TCN converts a data format of the image signal RGB to correspond to an interface between the data driver DDV and the timing controller TCN, and applies the converted image signals R'G'B' to the data driver DDV. In an exemplary embodiment, the timing controller TCN generates a data control signal D-CS, e.g., an output start signal, a horizontal start signal, etc., and a gate control signal G-CS, e.g., a vertical start signal, a vertical clock signal, a vertical clock bar signal, etc., based on the control signals CS. The data control signal D-CS is applied to the data driver DDV, and the gate control signal G-CS is applied to the gate driver GDV.

The gate driver GDV sequentially outputs gate signals in response to the gate control signal G-CS provided from the timing controller TCN. Accordingly, the pixels PX are sequentially scanned by the gate signals in the unit of a row.

The data driver DDV converts the image signals R'G'B' to data voltages in response to the data control signal D-CS. The data voltages are applied to the display panel PNL.

Thus, each pixel PX is turned on by the gate signal, and the turned-on pixel PX displays the image having a predetermined gray scale corresponding to image signals RGB using a corresponding data voltage of the data voltages provided from the data driver DDV.

In an exemplary embodiment, as shown in FIG. 1, the display apparatus DSP further includes a backlight unit BLU disposed at a rear side of the display panel PNL. The backlight unit BLU provides light to the display panel PNL at the rear side of the display panel PNL. In an exemplary embodiment, the backlight unit BLU may include a plurality of light sources, e.g., a plurality of light emitting diodes (not shown). In such an embodiment, the light emitting diodes are disposed on a printed circuit board in a stripe form or a matrix form.

Figure 2:
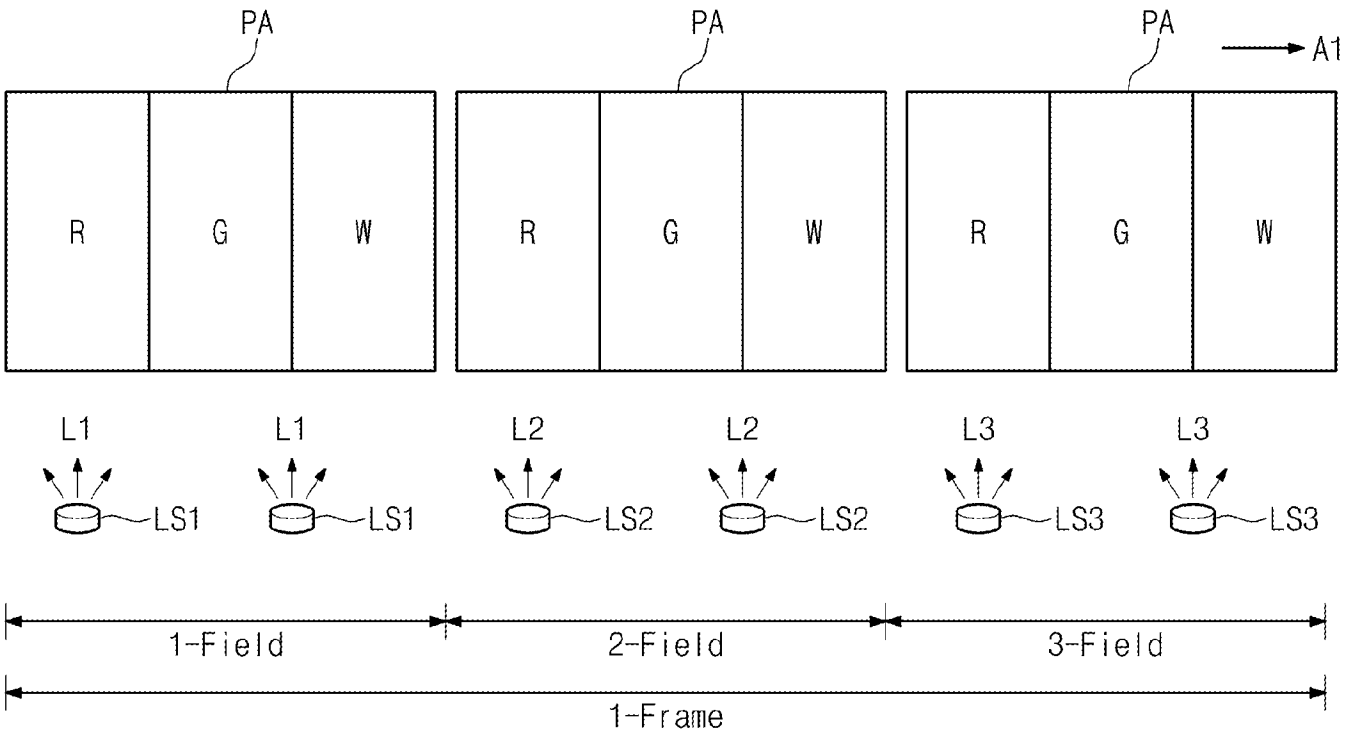
FIG. 2 is a view showing a principle of realizing a full color image in an exemplary embodiment of a display apparatus using time and space division schemes.

FIG. 2 is a view showing a principle of realizing a full color image using time and space division schemes.

Referring to FIG. 2, the display panel PNL (shown in FIG. 1), which uses the time and space division schemes to display images, includes first and second color filters having different colors from each other. In one exemplary embodiment, for example, the first and second color filters include a red color filter R to produce a red color and a green color filter G to produce a green color. When an area corresponding to a pixel is referred to as a pixel area PA, each pixel area PA includes the red and green color filters R and G. In such an embodiment, each pixel area PA includes an open portion W, in which the first and second color filters R and G are not disposed. The open portion W is disposed adjacent to a side of one of the red and green color filters R and G. The red color filter R, the green color filter G and the open portion W are arranged in a first direction A1, but not being limited thereto.

In an exemplary embodiment, the backlight unit BLU (shown in FIG. 1) includes a first light source LS1 that emits a first color light L1, a second light source LS2 that emits a second color light L2, and a third light source LS3 that emits a third color light L3. A frame 1-Frame is divided into three sub-fields, e.g., a first sub-field 1-Field, a second sub-field 2-Field and a third sub-field 3-Field, according to a time sequence. In the first field 1-Field, the first light source LS1 is driven and the first color light L1 is emitted from the backlight unit BLU, thereby supplying the first color light L1 to the display panel PNL. Then, in the second field 2-Field, the second light source LS2 is driven and the second color light L2 is emitted from the backlight unit BLU, thereby supplying the second color light L2 to the display panel PNL. In the third field 3-Field, the third light source LS3 is driven and the third color light L3 is emitted from the backlight unit BLU, thereby supplying the third color light L3 to the display panel PNL.

In an exemplary embodiment, the first color light L1 may be a yellow color light. When the first color light L1 perceived by a viewer is the yellow color light, a wavelength of the light is positioned in a spectral band corresponding to a yellow color on a spectrum or spectral bands corresponding to red and green colors on the spectrum. When the wavelength of the light is positioned in the spectral band corresponding to a yellow color on the spectrum, a peak of the spectrum is positioned in the spectral band corresponding to the yellow color, and a portion of the spectrum may be positioned in the spectral bands corresponding to the green and red colors. When the wavelength of the light is positioned in the spectral band corresponding to red and green colors on the spectrum, the peaks of the spectrum are positioned in each spectral band corresponding to the green and red colors and each peak has a full-width-half-maximum relatively narrower than when the wavelength of the light is positioned in the spectral band corresponding to the yellow color on the spectrum. In an exemplary embodiment, a wavelength of the first color light L1 is positioned in the spectral band corresponding to the red and green colors on the spectrum such that the red and green color light are mixed with each other, and thus yellow color light is perceived by a viewer.

The second color light L2 may have substantially the same color as the first color light L1. In an exemplary embodiment, the first and second color lights L1 and L2 are at the same position in a CIE 1931 color coordinate system and perceived by the viewer as the yellow color light. However, the second color light L2 has a spectral band different from a spectral band of the first color light L1. In an exemplary embodiment, the peak of the spectrum is at a position corresponding to the yellow color in the second color light L2.

The third color light L3 has a spectral band different from the spectral bands of the first and second color lights L1 and L2. In an exemplary embodiment, the third color light L3 may be a blue light.

In an exemplary embodiment, a red light component of the first color light L1 generated from the backlight unit BLU passes through the first color filter R and is displayed as a red image during the first sub-field 1-Field, and a green light component of the first color light L1 passes through the second color filter G and is displayed as a green image during the first sub-field 1-Field. During the second sub-field 2-Field, the second color light L2 generated from the backlight unit BLU passes through the open portion W and is displayed as a yellow image. During the third sub-field 3-Field, the third color light L3 generated from the backlight unit BLU passes through the open portion W and is displayed as a blue image.

In such an embodiment, as described above, the open portion W is provided to allow the yellow image and the blue image to be displayed during the second and third sub-fields 2-Field and 3-Field. In such an embodiment, the open portion W effectively prevents the color breakup phenomenon from occurring in the time division scheme and substantially enhances brightness. In such an embodiment, the size of the open portion W may be determined to have a predetermined transmittance based on predetermined brightness or color of the frame.

Figure 3A:
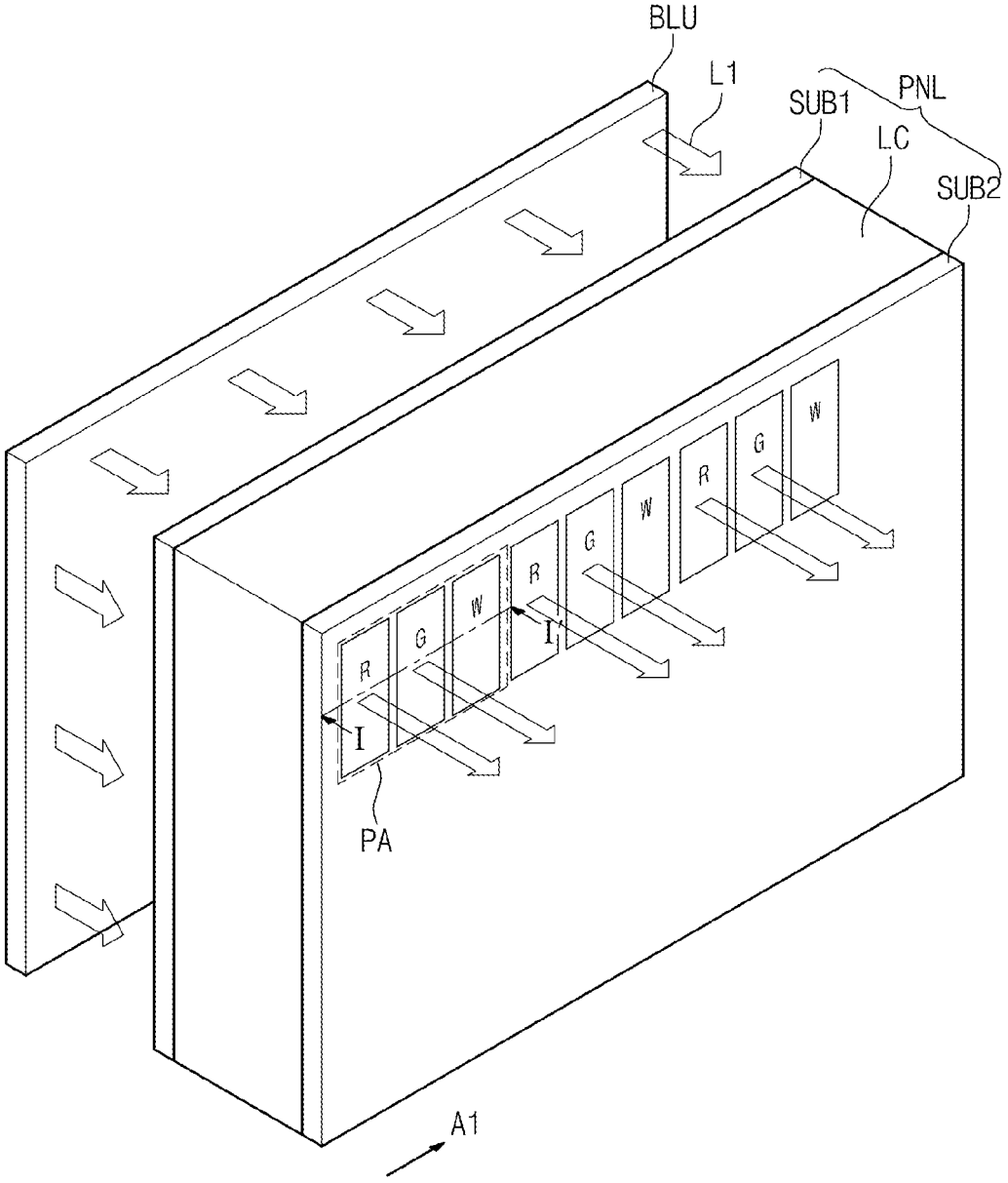
FIGS. 3A to 3C are schematic perspective views of an exemplary embodiment of a display apparatus using time and space division schemes according to the invention.
Figure 3B:
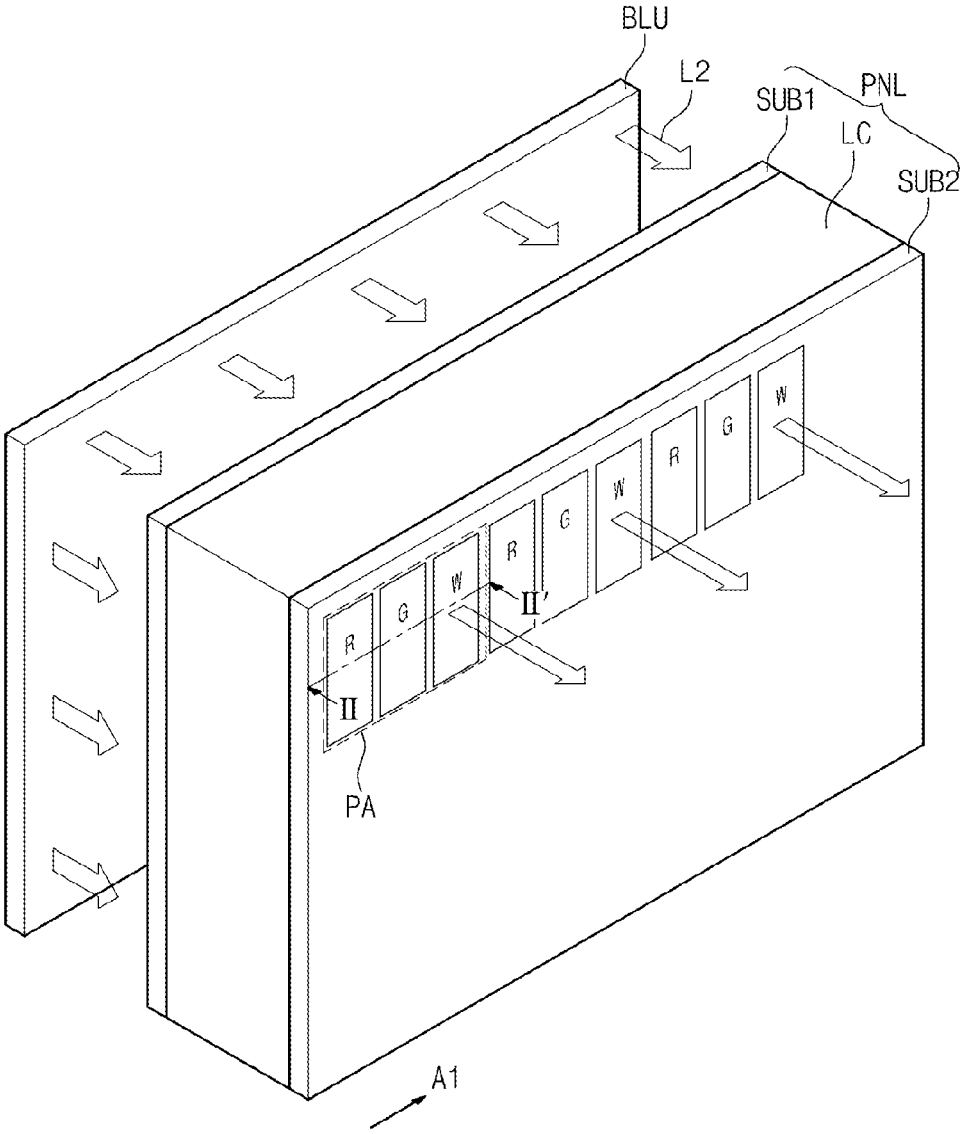
Figure 3C:
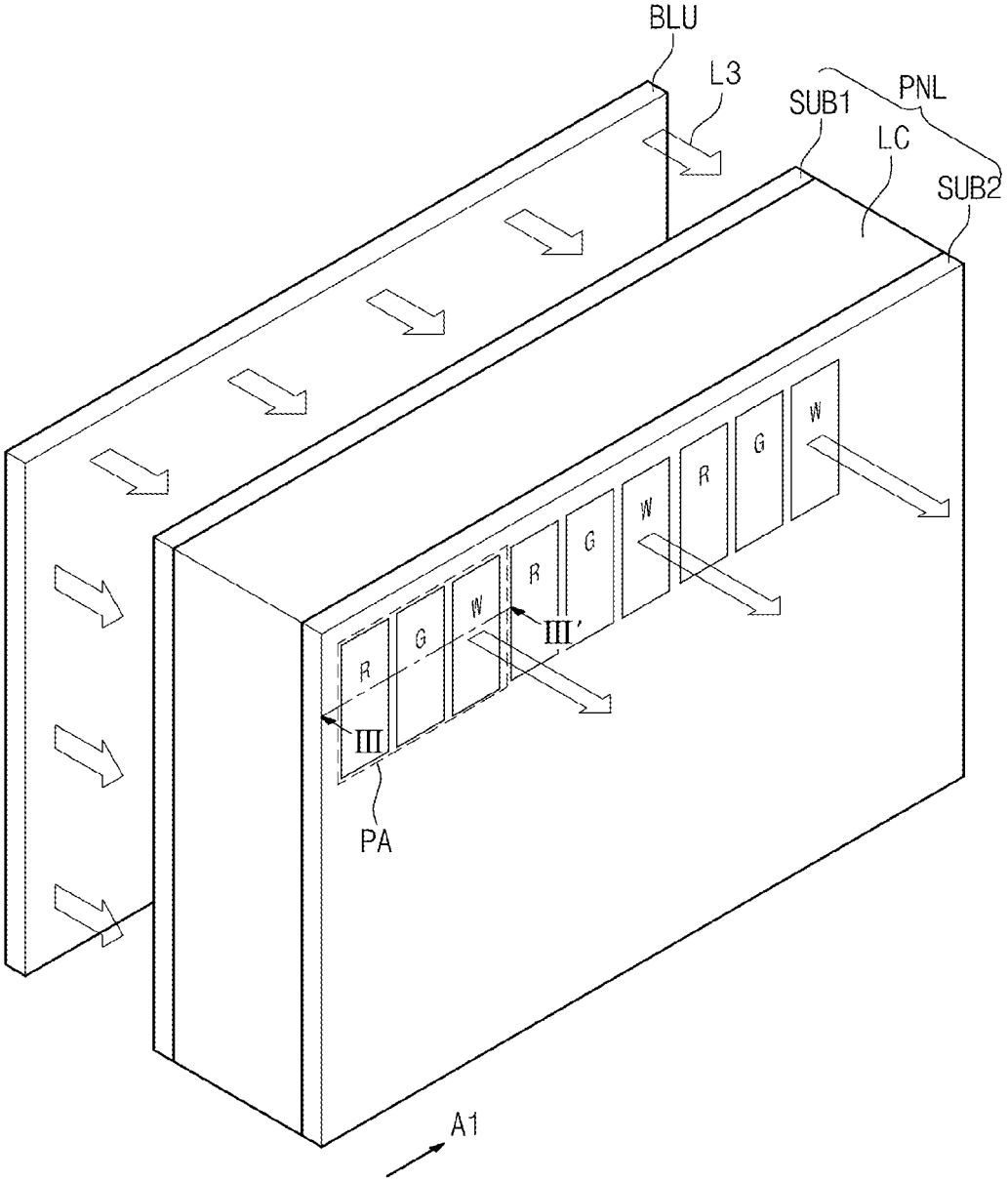
Figure 4A:
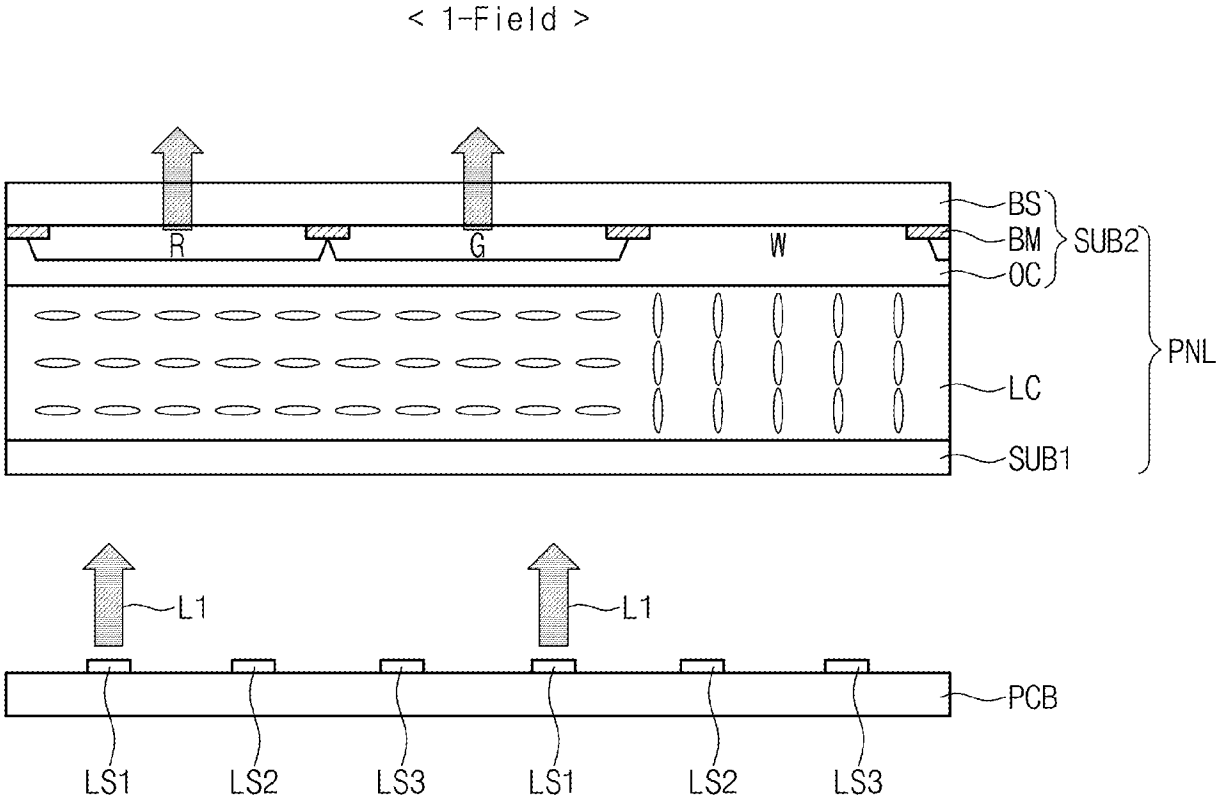
FIG. 4A is a cross-sectional view taken along line I-I' of FIG. 3A.
Figure 4B:
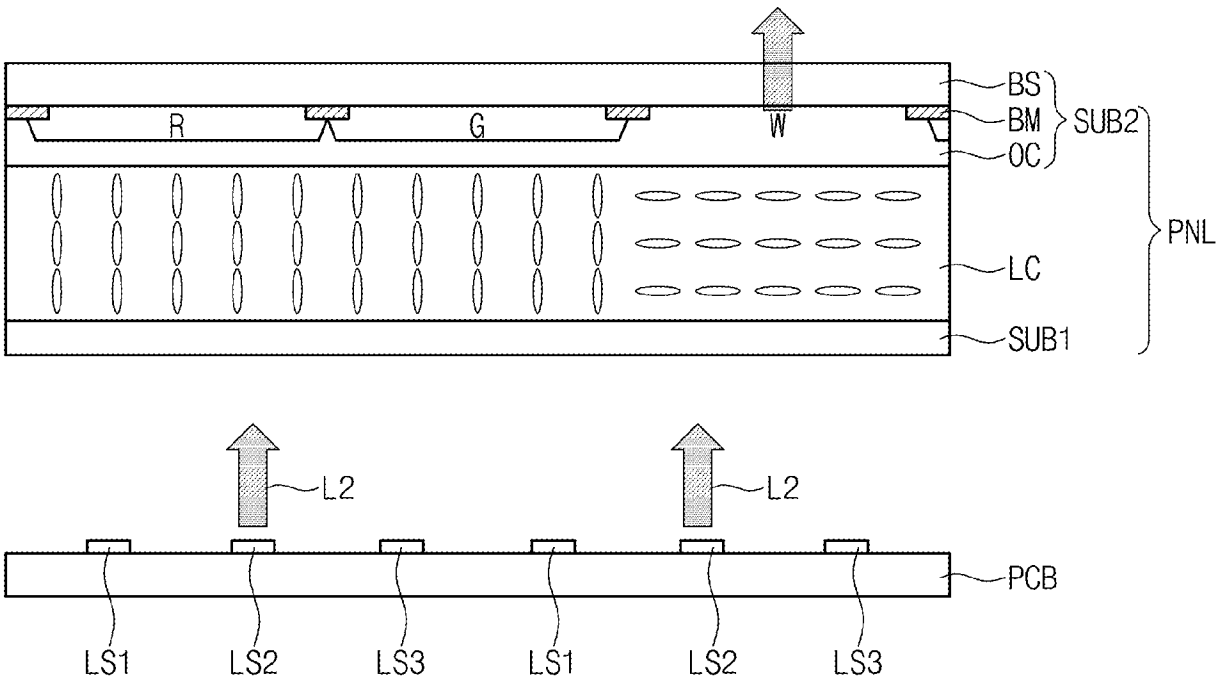
FIG. 4B is a cross-sectional view taken along line II-II' of FIG. 3B.
Figure 4C:
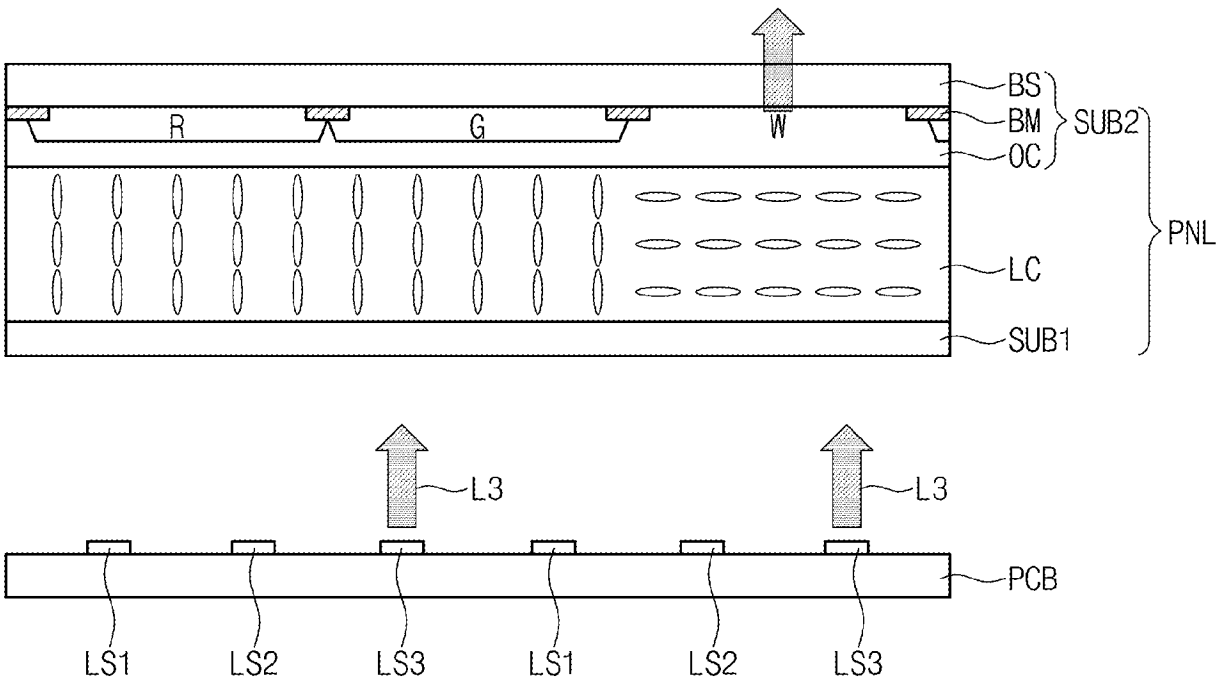
FIG. 4C is a cross-sectional view taken along line II-II' of FIG. 3C.

FIGS. 3A to 3C are perspective views an exemplary embodiment of a display apparatus using time and space division schemes according to the invention. FIG. 4A is a cross-sectional view taken along line I-I' of FIG. 3A, FIG. 4B is a cross-sectional view taken along line II-II' of FIG. 3B, and FIG. 4C is a cross-sectional view taken along line III-III' of FIG. 3C. In detail, FIGS. 3A and 4A show an operation mode of the display panel PNL in the first sub-field of the frame, FIGS. 3B and 4B show an operation of the display panel PNL in the second sub-field of the frame, and FIGS. 3C and 4C show an operation mode of the display panel PNL in the third sub-field of the frame.

In an exemplary embodiment, the operation mode of the display panel PNL and the backlight unit BLU is changed every first, second and third sub-fields 1-Field, 2-Field and 3-Field, but the structure of the display panel PNL and the backlight unit BLU is not changed. Hereinafter, the structure of an exemplary embodiment of the display panel PNL and the backlight unit BLU will be described with reference to FIGS. 3A and 4.

Referring to FIGS. 3A and 4A, the display panel PNL includes the red and green color filters R and G repeatedly arranged in the first direction A1.

In an exemplary embodiment, the display panel PNL includes a first substrate SUB1, a second substrate SUB2 disposed opposite to the first substrate SUB1, and a liquid crystal layer LC interposed between the first substrate SUB1 and the second substrate SUB2.

In an exemplary embodiment, the first substrate SUB1 may be a lower substrate on which the thin film transistor Tr (shown in FIG. 1) and a first electrode, i.e., a pixel electrode, of the liquid crystal capacitor Clc of each pixel PX (shown in FIG. 1) are disposed. The second substrate SUB2 may be an upper substrate on which the two color filters R and G disposed in each pixel area PA corresponding to each pixel PX and a second electrode, i.e., a reference electrode, of the liquid crystal capacitor Clc are disposed.

In FIGS. 4A to 4C, for the convenience of illustration, the pixels disposed on the first substrate SUB1 and the reference electrode disposed on the second substrate SUB2 are omitted.

Referring to FIG. 4A, the second substrate SUB2 includes a base substrate BS, the red and green color filters R and G disposed on the base substrate BS, a black matrix BM disposed along an edge of the red and green color filters R and G, and an overcoating layer OC covering the red and green color filters R and G and the black matrix BM.

The open portion W is defined on the base substrate BS to be adjacent to at least one side of the red and green color filters R and G.

The overcoating layer OC may be an organic insulating layer. In an exemplary embodiment, the overcoating layer OC covers the red and green color filters R and G and the open portion W such that a step difference between the area, in which the color filters are disposed, and the area, in which the open portion W is disposed, is substantially reduced.

In an exemplary embodiment, the backlight unit BLU includes the first light source LS1, the second light source LS2, the third light source LS3, and the printed circuit board PCB on which the first, second and third light sources LS1, LS2 and LS3 are mounted. In an exemplary embodiment, the first light source LS1, the second light source LS2, and the third light source LS3 are alternately arranged with each other on the printed circuit board PCB, but not being limited thereto or thereby.

In such an embodiment, the first light source LS1 emits the first color light L1, the second light source LS2 emits the second color light L2, and the third light source L3 emits the third color light L3.

During the first sub-field 1-Field, the first light source LS1 is driven to emit the first color light L1, but the second and third light sources LS2 and LS3 are turned off.

In an exemplary embodiment, each pixel (not shown) includes a red sub-pixel disposed corresponding to the red color filter R, a green sub-pixel disposed corresponding to the green color filter G, and a white sub-pixel disposed corresponding to the open portion W. In such an embodiment, the white sub-pixel transmits the light passing through the open portion W, but the white sub-pixel does not display a white color.

Each of the red, green and white sub-pixels includes the thin film transistor and the liquid crystal capacitor such that the red, green and white sub-pixels operate independently of each other.

The red and green sub-pixels operate in the first sub-field 1-Field and the white sub-pixel does not operate. Thus, the first color light L1 emitted from the first light source LS1 passes through the red and green color filters R and G, and then is displayed as the image. In such an embodiment, the red and green sub-pixels are independently driven to display the red, green or yellow image by controlling the operation of each sub-pixel. In such an embodiment, when only the red sub-pixel operates, the red image is displayed, and the green image is displayed when only the green sub-pixel operates. When the red and green sub-pixels substantially simultaneously operate, the yellow image is displayed.

Referring to FIGS. 3B and 4B, during the second sub-field 2-Field, the second light source LS2 is driven to emit the second color light L2, but the first and third light sources LS1 and LS3 are turned off.

In such an embodiment, the red and green sub-pixels do not operate in the second sub-field 2-Field, but the white sub-pixel operates in the second sub-field 2-Field. Accordingly, the second color light L2 emitted from the second light source LS2 does not pass through the red and green color filters R and G, and passes through the open portion W, thereby displaying the yellow image.

Referring to FIGS. 3C and 4C, during the third sub-field 3-Field, the third light source LS3 is driven to emit the third color light L3, but the first and second light sources LS1 and LS2 are turned off.

In such an embodiment, the red and green sub-pixels R and G do not operate in the third sub-field 3-Field, but the white sub-pixel operates in the third sub-field 3-Field. Accordingly, the third color light L3 emitted from the third light source LS3 does not pass through the red and green color filters R and G, and passes through the open portion W, thereby displaying the blue image.

Figure 5A:
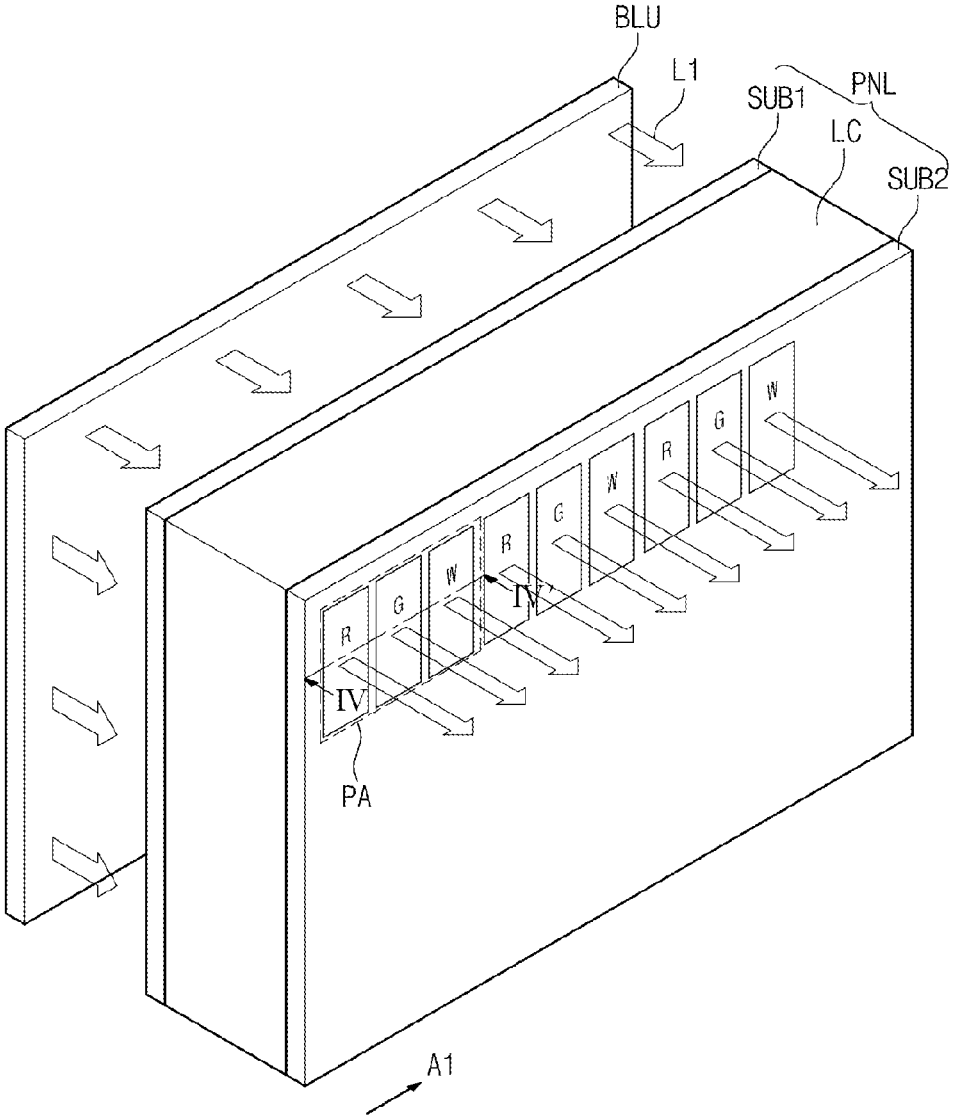
FIGS. 5A to 5C are schematic perspective views of an alternative exemplary embodiment of a display apparatus using time and space division schemes according to the invention.
Figure 5B:
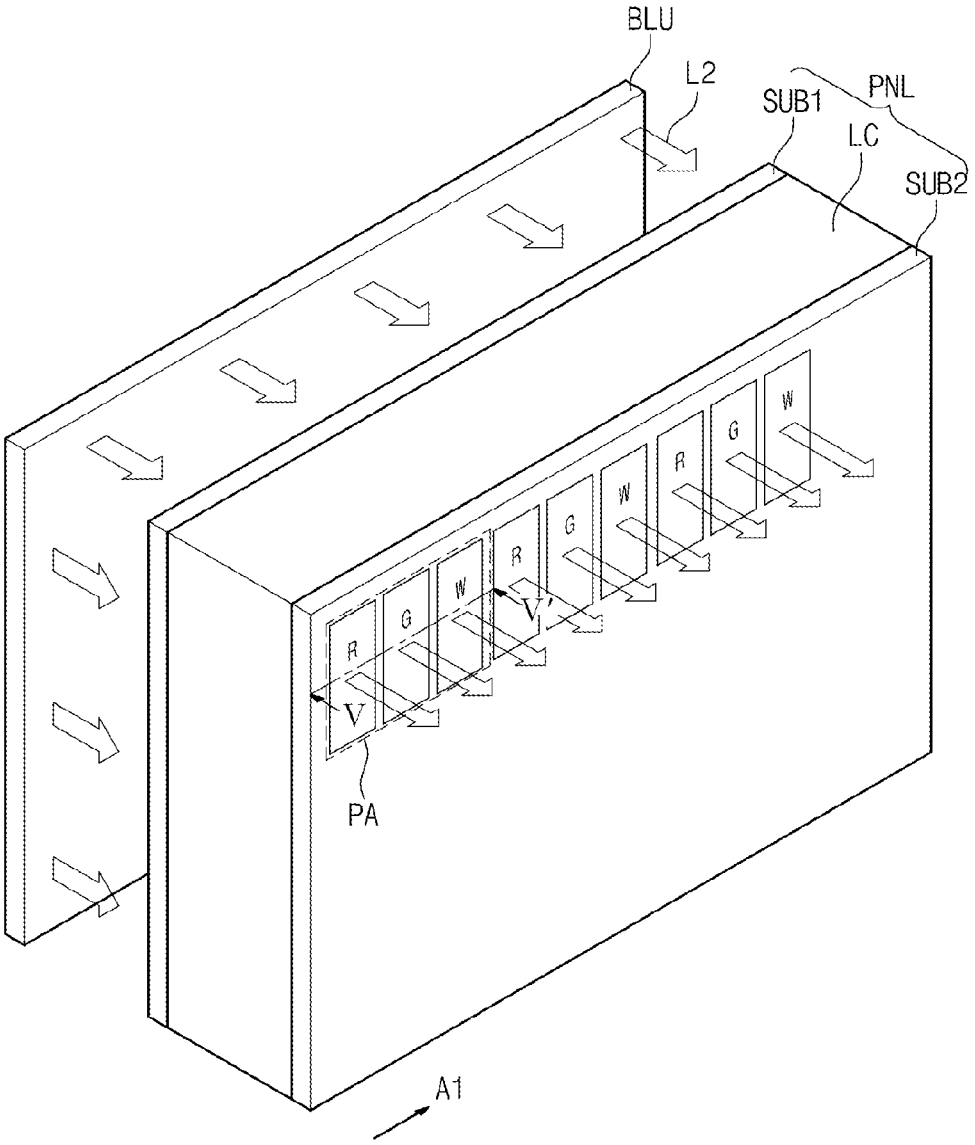
Figure 5C:
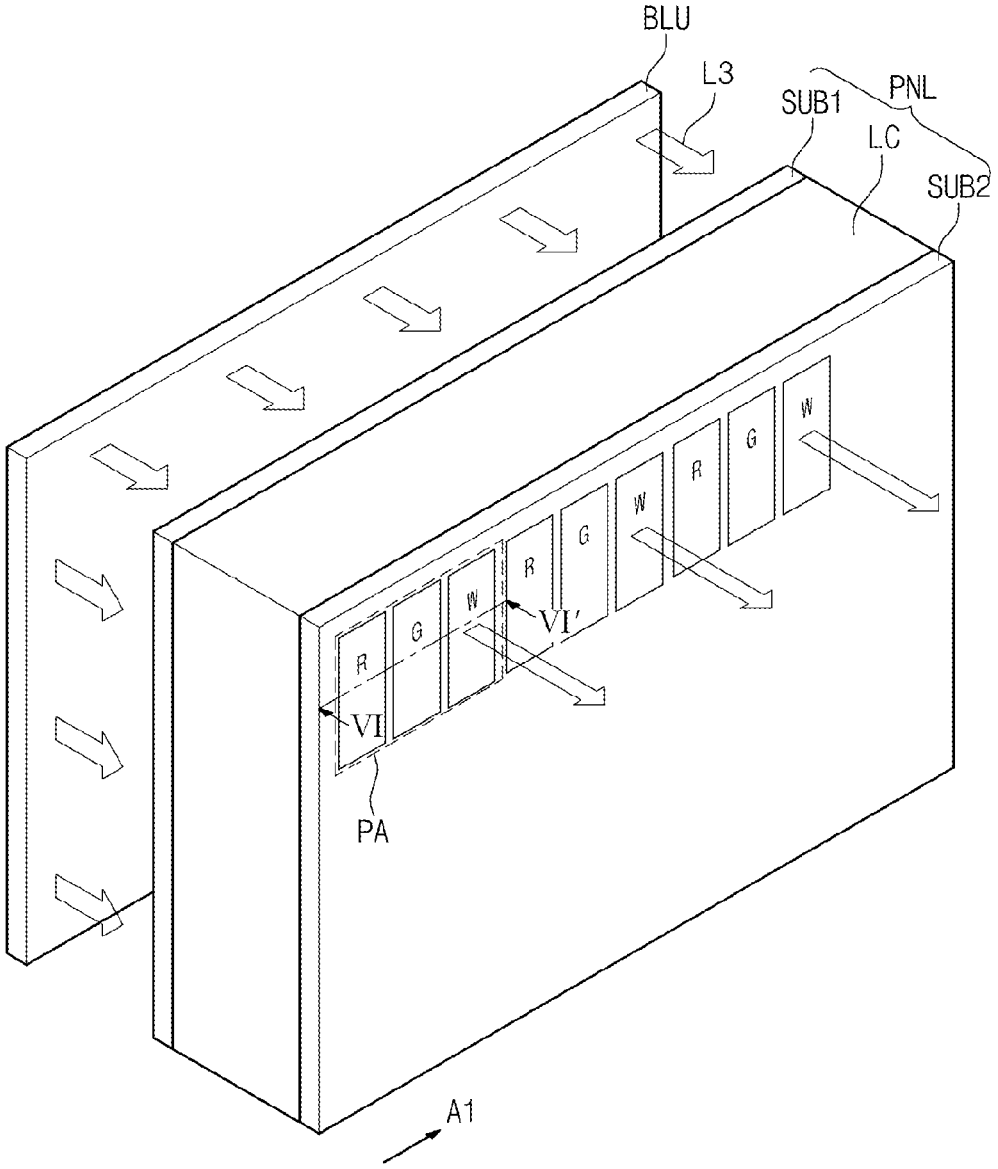
Figure 6A:
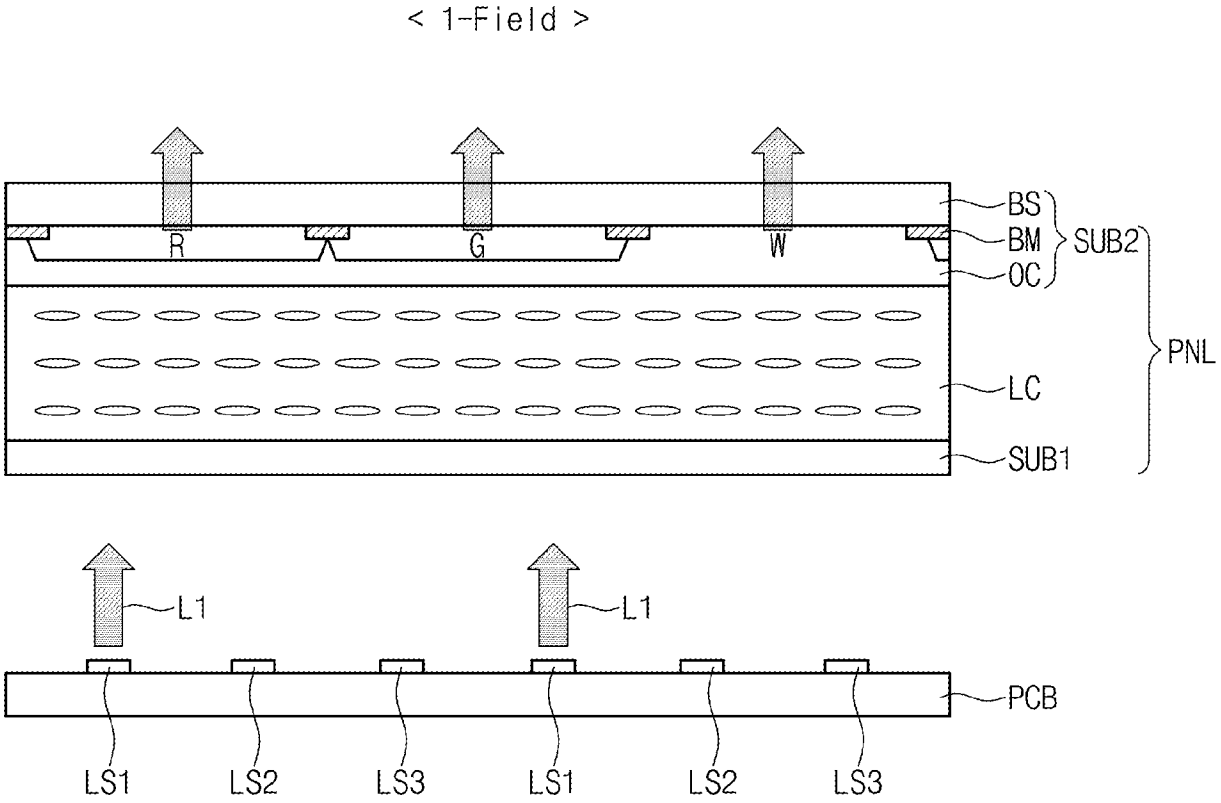
FIG. 6A is a cross-sectional view taken along line IV-IV' of FIG. 5A.
Figure 6B:
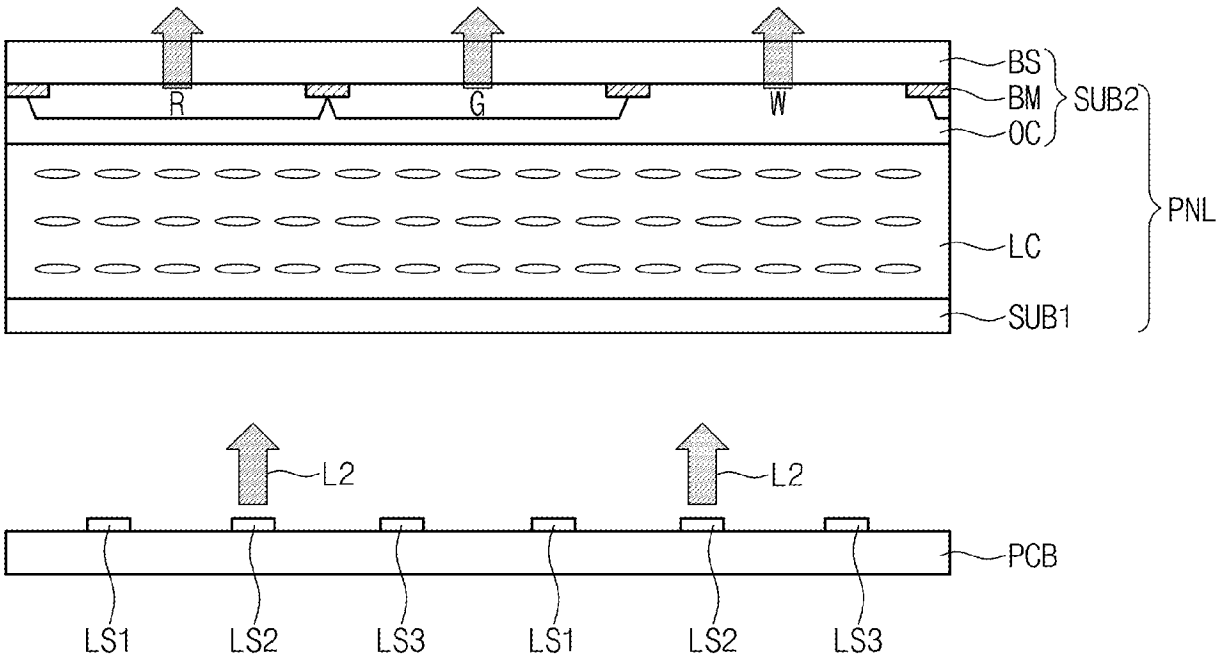
FIG. 6B is a cross-sectional view taken along line V-V' of FIG. 5B.
Figure 6C:
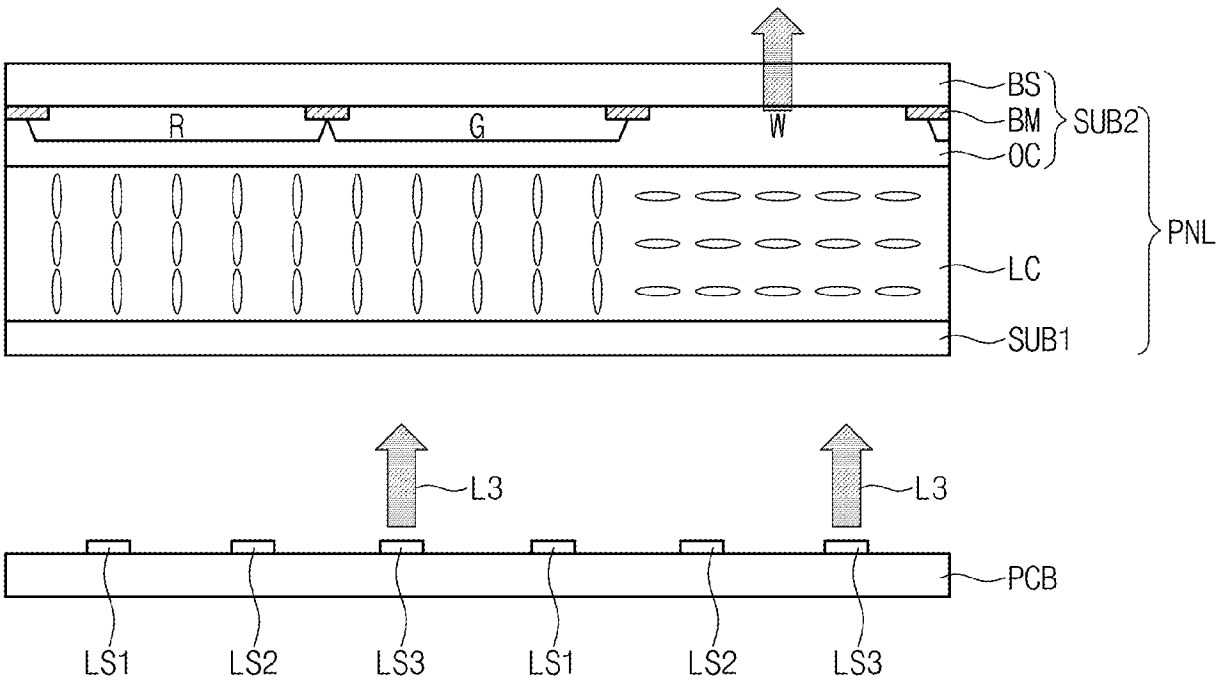
FIG. 6C is a cross-sectional view taken along line VI-VI' of FIG. 5C.

FIGS. 5A to 5C are perspective views of an alternative exemplary embodiment of a display apparatus using time and space division schemes according to the invention. FIG. 6A is a cross-sectional view taken along line IV-IV' of FIG. 5A, FIG. 6B is a cross-sectional view taken along line V-V' of FIG. 5B, and FIG. 6C is a cross-sectional view taken along line VI-VI' of FIG. 5C. In detail, FIGS. 5A and 6A show an operation mode of the display panel PNL in the first sub-field of the frame, FIGS. 5B and 6B show an operation mode of the display panel PNL in the second sub-field of the frame, and FIGS. 5C and 6C show an operation mode of the display panel PNL in the third sub-field of the frame.

Referring to FIGS. 5A and 6A, during the first sub-field 1-Field, the first light source LS1 is driven to emit the first color light L1, but the second and third light sources LS2 and LS3 are turned off.

The red, green and white sub-pixels R, G and W operate in the first sub-field 1-Field. Accordingly, the first color light L1 emitted from the first light source LS1 passes through the red color filter R, the green color filter G and the open portion W, and then is displayed as the image.

Referring to FIGS. 5B and 6B, the second light source LS2 is driven during the second sub-field 2-Field to emit the second color light L2, but the first and third light sources LS1 and LS3 are turned off.

In such an embodiment, the red, green and white sub-pixels R, G and W operate in the second sub-field 2-Field. Accordingly, the second color light L2 emitted from the second light source LS2 passes through the red color filter R, the green color filter G and the open portion W, and then is displayed as the image. In such an embodiment, an amount of the second color light L2 is smaller than an amount of the first color light L1.

Referring to FIGS. 5C and 6C, the third light source LS3 is driven during the third sub-field 3-Field to emit the third color light L3, but the first and second light sources LS1 and LS2 are turned off.

In such an embodiment, the red and green sub-pixels R and G do not operate, but the white sub-pixel W operates in the third sub-field 3-Field. Accordingly, the third color light L3 emitted from the third light source LS3 does not pass through the red and green color filters R and G, and passes through the open portion W, and then is displayed as the blue image.

In an exemplary embodiment, the display apparatus may operate in the above-mentioned driving method, but not being limited thereto or thereby. In an alternative exemplary embodiment, the sub-pixels and the light sources may operate in different orders from each other with respect to the first, second and third sub-fields 1-Field, 2-Field and 3-Field. In one exemplary embodiment, for example, the first color light L1 may be emitted from the first light source LS1 during the first sub-field 1-Field, and thus only the red and green sub-pixels operate. Then, the third color light L3 may be emitted from the third light source LS3 during the second sub-field 2-Field, such that only the white sub-pixel operates, and then the second color light L2 may be emitted from the second light source LS2 during the third sub-field 3-Field, and thus only the white sub-pixel operates.

In an exemplary embodiment of the display apparatus, only two color filters are used, such that the display apparatus may be efficiently manufactured and a manufacturing cost of the display apparatus may be reduced. In such an embodiment, the color reproducibility may be substantially improved and the color breakup phenomenon may be substantially reduced.

Figure 7:
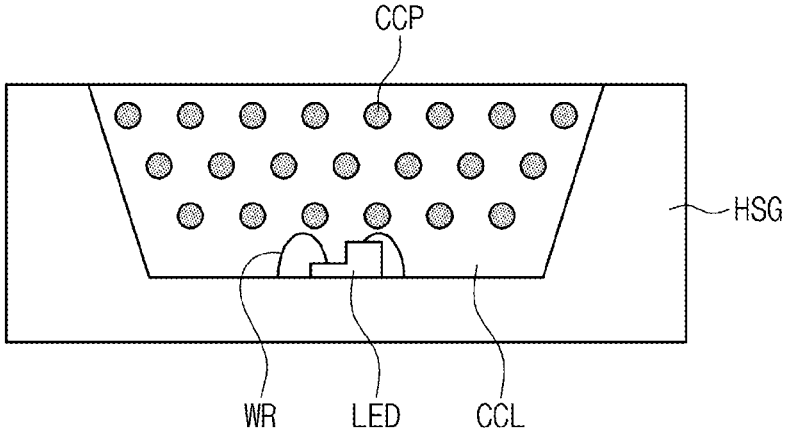
FIG. 7 is a cross-sectional view showing an exemplary embodiment of a first light source unit according to the invention.

In an exemplary embodiment, the first light source unit LS1 provides the first color light to the display panel PNL. FIG. 7 is a cross-sectional view showing an exemplary embodiment of a first light source unit according to the invention.

Referring to FIG. 7, the first light source includes a light source chip, e.g., a light emitting diode LED, that emits light having a predetermined spectral band, a first photo-converter CCL that covers the light source chip LED and converts the light to the first color light, and a housing HSG that accommodates the light source chip LED and the first photo-converter CCL.

The light source chip LED emits the light and is accommodated in the housing HSG. The light source chip LED may be the light emitting diode chip, but not being limited thereto as long as the light source chip emits the light having the predetermined spectral band. The light emitted from the light source chip LED may be the blue color light, and the wavelength of the blue color light is in a range of about 435 nanometers (nm) to about 460 nanometers (nm).

The housing HSG provides a space therein to accommodate the light source chip LED and the first photo-converter CCL, and a side portion of the housing HSG is opened. The light source chip LED is connected to an external power supply (not shown) by a wire WR, which may be provided through the housing HSG.

In an exemplary embodiment, the first photo-converter CCL includes a photo-converting material CCP to absorb the light emitted from the light source chip LED and having the spectral band and convert the light to the first color light, e.g., the yellow color light. In such an embodiment, the peaks of the spectrum of the yellow color light are at positions in spectral bands corresponding to the green and red colors. In such an embodiment, the yellow color light may include the green color light having a wavelength in a range of about 470 nm to about 590 nm and the red color light having a wavelength in a range of about 560 nm to about 580 nm.

In an exemplary embodiment, the photo-converting material CCP is not be limited to a specific material as long as the material absorbs the light having the spectral band and converts the light to the first color light. In an exemplary embodiment, the photo-converting material CCP may include a plurality of quantum dots that emit the green and red color light. The quantum dot may emit the green and red color light with the full-width-half-maximum narrower than the full-width-half-maximum of the green and red color light emitted from a conventional photo-converting material, e.g., phosphor, such that the color reproducibility is substantially improved.

Figure 8:
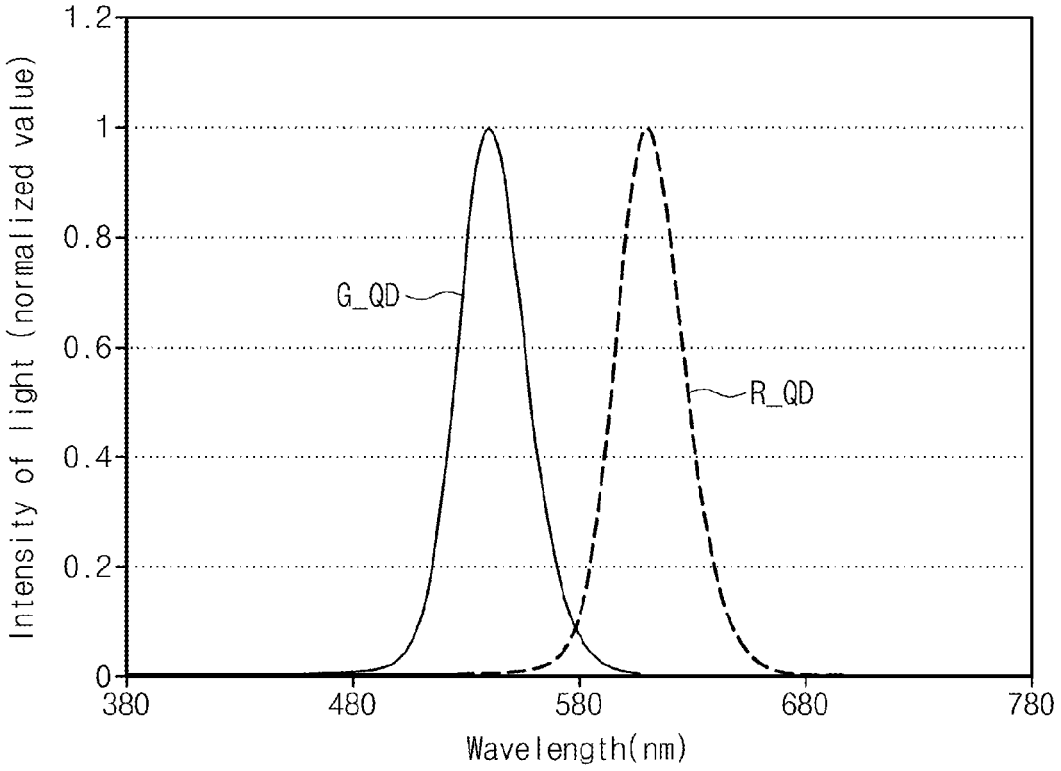
FIG. 8 is a graph showing a spectrum of a first color light emitted from an exemplary embodiment of a first light source of a backlight unit according to the invention.

FIG. 8 is a graph showing a spectrum of a first color light emitted from an exemplary embodiment of a first light source according to the invention. Referring to the spectrum shown in FIG. 8, the peak is located at about 530 nm corresponding to the green color and about 610 nm corresponding to the red color, and the light is perceived by a viewer as the yellow color light. The first color light of FIG. 8 may be generated by a light source including a green quantum dot G_QD that emits the green light and a red quantum dot R_QD that emits the red light.

The second light source includes a light source chip that emits the light with the first spectral band, a second photo-converter that covers the light source chip and converts the light having the first wavelength to the second color light, and a housing that accommodates the light source chip and the second photo-converter. The second light source has substantially the same structure and function as the first light source except for the second photo-converter. The light source chip of the second light source may emit the light having substantially the same color and spectral band as the light source chip of the first light source.

In an exemplary embodiment, the second photo-converter includes a photo-converting material that absorbs the light emitted from the light source chip and having the first spectral band, and converts the light to the second color light, e.g., the yellow color light. In such an embodiment, the peak of the spectrum of the yellow color light is located at a position in a spectral band corresponding to the yellow color.

The photo-converting material is not be limited to a specific material as long as the material absorbs the light having the first spectral band and converts the light to the second color light. In one exemplary embodiment, for example, the photo-converting material may be a phosphor. In an exemplary embodiment, where the photo-converting material is the phosphor, the yellow color light has a full-width-half-maximum greater than a full-width-half-maximum of a yellow color light based on the quantum dot, and may generate white color light together with the third color light.

Figure 9:
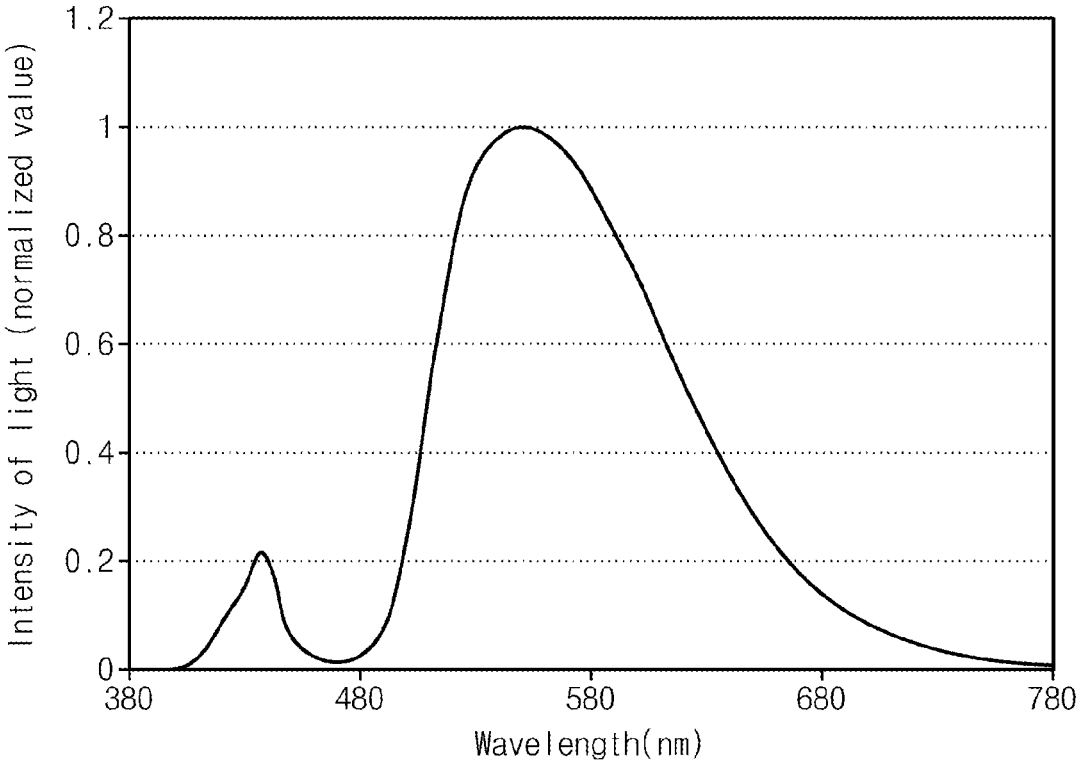
FIG. 9 is a graph showing a spectrum of a second color light emitted from an exemplary embodiment of a second light source of a backlight unit according to the invention.

FIG. 9 is a graph showing a spectrum of a second color light emitted from an exemplary embodiment of a second light source of a backlight unit according to the invention.

Referring to the spectrum shown in FIG. 9, the peak of the second color light is located at a position corresponding to a yellow color area and perceived by the viewer as a yellow color light. The second color light of FIG. 9 is generated using a phosphor that emits the yellow color light as the photo-converting material.

Figure 10:
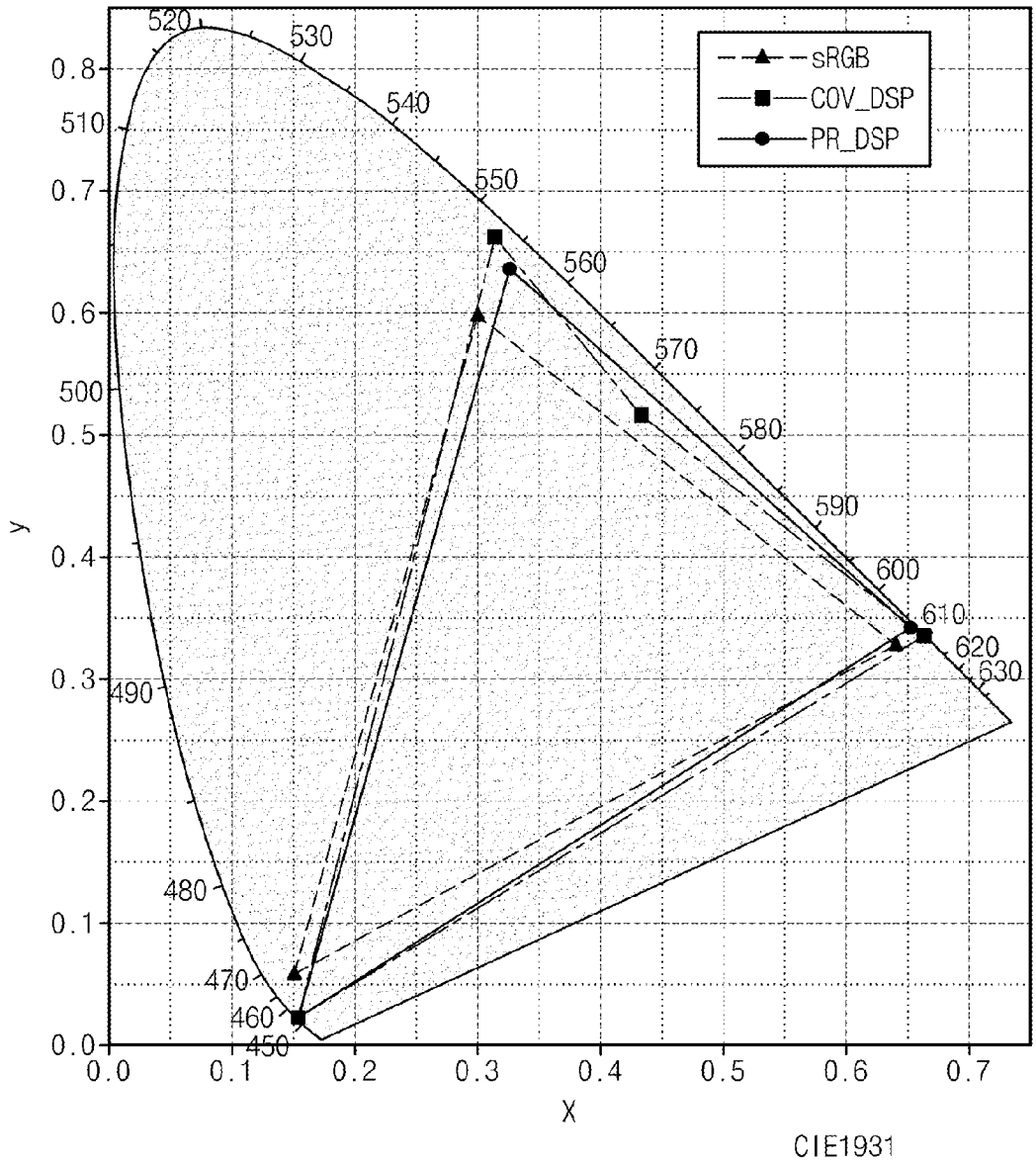
FIG. 10 is a CIE 1931 color coordinate diagram showing color areas of images of a conventional display apparatus and an exemplary embodiment of a display apparatus according to the invention.

FIG. 10 is a CIE 1931 color coordinate diagram showing color areas of images of a conventional display apparatus and an exemplary embodiment of a display apparatus according to the invention. FIG. 10 shows a sRGB area indicated by sRGB, a color area of the conventional display apparatus, which is indicated by COV_DSP, and a color area of an exemplary embodiment of the display apparatus, which is indicated by PR_DSP.

Referring to FIG. 10, an accordance rate between the color area of the conventional display apparatus and the sRGB is about 93.1%, and the accordance rate between the color area of an exemplary embodiment of the display apparatus and the sRGB is about 97.5%. In the exemplary embodiment, the accordance rate is increased about 4.4%.

In FIG. 10, a degree of overlap between the color area of the conventional display apparatus and a color area of a national television system committee ("NTSC") is about 79.4% and the degree of overlap between the color area of the display apparatus according to the exemplary embodiment and the color area of the NTSC is about 83.3%. In the exemplary embodiment, the degree of overlap is increased about 4%.

As described above, an image displayed by an exemplary embodiment of the display apparatus according to the invention has the higher accordance rate with respect to the sRGB and the higher degree of overlap with respect to the NTSC than an image displayed by the conventional display apparatus, and thus the color reproducibility of an exemplary embodiment of the display apparatus according to the invention is improved.

In an exemplary embodiment, as described above, the second photo-converter may include the phosphor as the photo-converting material. In an alternative exemplary embodiment, the second photo-converter may include a quantum dot that emits the yellow color light instead of the phosphor. In such an embodiment, the quantum dot may be different from the quantum dot included in the first photo-converter. The quantum dot has a peak in a yellow color spectral band and emits a light having a full-width-half-maximum narrower than the light emitted from the phosphor. Accordingly, in an exemplary embodiment, the color coordinate of the yellow light source is determined to be closer to a portion in which color purity is maximum in the color coordinate system, and thus a color reproducing area become wider.

Figure 11:
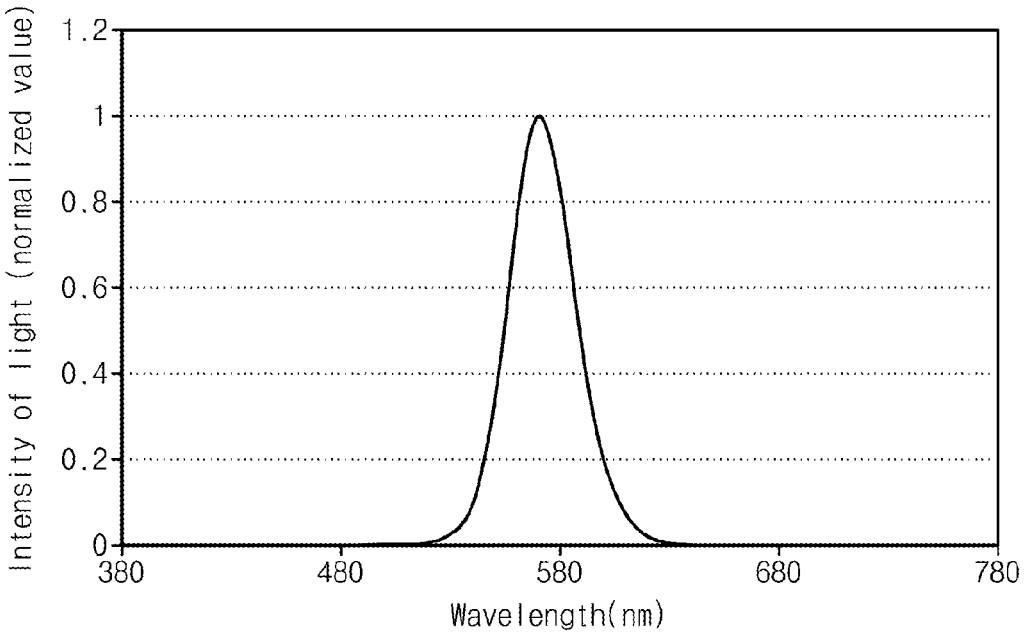
FIG. 11 is a graph showing a spectrum of a second color light emitted from an alternative exemplary embodiment of a first light source of a backlight unit according to the invention.

FIG. 11 is a graph showing a spectrum of a second color light of an alternative exemplary embodiment of the second light source of a backlight unit according to the invention.

Referring to the spectrum shown in FIG. 11, the peak of the second color light is located at a position corresponding to a yellow color area and perceived by the viewer as the yellow color light. The second color light of FIG. 11 is generated using a quantum dot that emits the yellow color light as the photo-converting material.

Figure 12:
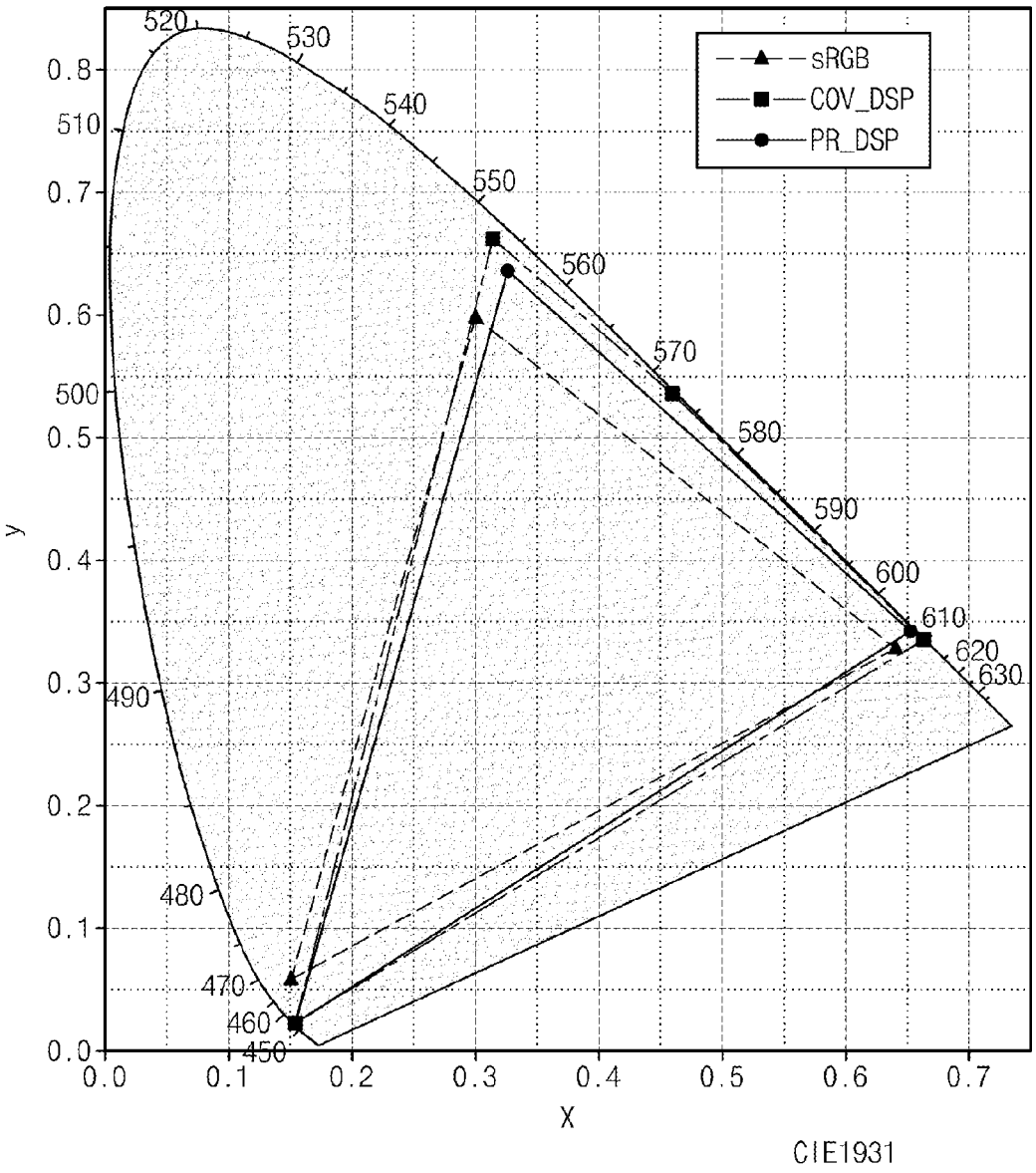
FIG. 12 is a CIE 1931 color coordinate diagram showing color areas of images of a convention display apparatus and an exemplary embodiment of a display apparatus including the second light source that emits the second color light with the spectrum shown in FIG. 11 according to the invention.

FIG. 12 is a CIE 1931 color coordinate diagram showing color areas of images of a conventional display apparatus and an exemplary embodiment of a display apparatus according to the invention. FIG. 12 shows an sRGB area indicated by sRGB, a color area of the conventional display apparatus, which is indicated by COV_DSP, and a color area of an exemplary embodiment of the display apparatus, which is indicated by PR_DSP.

Referring to FIG. 12, an accordance rate between the color area of the conventional display apparatus and the sRGB is about 93.1%, and the accordance rate between the color area of the display apparatus according to the exemplary embodiments and the sRGB is about 97.5%. In an exemplary embodiment, the accordance rate is increased about 4.4%.

In FIG. 12, the degree of overlap between the color area of the conventional display apparatus and a color area of the NTSC is about 79.4%, and the degree of overlap between the color area of an exemplary embodiment of the display apparatus and the color area of the NTSC is about 88.2%. That is, the degree of overlap is increased about 9%.

As described above, an image displayed by an exemplary embodiment of the display apparatus according to the invention has the higher accordance rate with respect to the sRGB and the higher degree of overlap with respect to the NTSC than an image displayed by the conventional display apparatus, and thus the color reproducibility of an exemplary embodiment of the display apparatus according to the invention is improved.

In an exemplary embodiment, where the display apparatus utilizes the first, second and third color lights, the display apparatus substantially corresponds to a display apparatus that utilizes two-color light sources since the first and second color lights are perceived as substantially the same color by the viewer.

In such exemplary embodiments, the display apparatus may reduce the color breakup phenomenon. The color breakup phenomenon means that the image is formed in a different position of the retina of a viewer's eye due to a difference between an object moving speed and an eye movement speed, and a color band is thereby formed at a border of the object and perceived by the viewer. The color breakup phenomenon may be represented by a color breakup index, and the color breakup index is obtained by calculating a color difference between a background and the object in an L'u'v' color space. In a conventional display apparatus that operates in the time division scheme using red, green and blue color light sources, the color breakup index is about 28.5. In an exemplary embodiment of the display apparatus, the color breakup index is about 4.0. Accordingly, the color breakup phenomenon of an exemplary embodiment of the display apparatus according to the invention is substantially reduced.

While the invention has been particularly shown and described with reference to exemplary embodiments thereof, it is understood that the invention is not be limited to these exemplary embodiments but various changes and modifications can be made by one ordinary skilled in the art within the spirit and scope of the invention as hereinafter claimed.

What is claimed is:

1. A display apparatus comprising:
a display panel comprising a plurality of pixels; and
a backlight unit disposed at a rear surface of the display panel and which provides light to the display panel, wherein
the backlight unit comprises:
a first light source which provides a first color light to the display panel;
a second light source which provides a second color light to the display panel; and
a third light source which provides a third color light to the display panel,
spectral bands of the first, second and third color light are different from each other,
the first color light and the second color light have substantially the same color as each other, and
the backlight unit uses only three different light sources to thereby provide essentially only two colors of light to the display panel.

2. The display apparatus of claim 1, wherein each of the first color light and the second color light is a yellow color light.

3. The display apparatus of claim 2, wherein a spectrum of the first color light has a peak in a spectral band corresponding to the yellow color light.

4. The display apparatus of claim 2, wherein a spectrum of the second color light has peaks in spectral bands corresponding to a red color light and a green color light.

5. The display apparatus of claim 2, wherein the third color light is a blue color light.

6. The display apparatus of claim 5, wherein
the display panel displays an image in a unit of a frame,
the frame comprises first, second and third sub-fields, and
the backlight unit provides the first, second and third color light during the first, second and third sub-fields, respectively.

7. The display apparatus of claim 6, wherein each of the pixels comprises:
a first color filter;
a second color filter having a color different from the first color filter;
an open portion defined outside of the first and second color filters,
a first sub-pixel corresponding to the first color filter;
a second sub-pixel corresponding to the second color filter; and
a third sub-pixel corresponding to the open portion,
wherein the first to third sub-pixels operate independently of each other.

8. The display apparatus of claim 7, wherein
the first color filter comprises a red color filter having a red color, and
the second color filter comprises a green color filter having a green color.

9. The display apparatus of claim 8, wherein
the first and second sub-pixels receive the first color light during the first sub-field,
the third sub-pixel receives the second color light during the second sub-field, and
the third sub-pixel receives the third color light during the third sub-field.

10. The display apparatus of claim 8, wherein
the first to third sub-pixels receive the first color light during the first sub-field,
the first to third sub-pixels receive the second color light during the second sub-field,
the third sub-pixel receives the third color light during the third sub-field, and
an amount of the first color light is greater than an amount of the second color light.

11. The display apparatus of claim 2, wherein
the first light source comprises:
a light source chip which emits a blue light; and
a first photo-converter which converts the blue light to the first color light,
the second light source comprises:
a light source chip which emits the blue light; and
a second photo-converter which converts the blue light to the second color light, and
the first and second photo-converters comprise different materials from each other.

12. The display apparatus of claim 11, wherein the first photo-converter comprises a quantum dot which absorbs the blue light and emits the first color light.

13. The display apparatus of claim 12, wherein a light emission spectrum of the quantum dot has peaks in areas corresponding to a green color light and a red color light.

14. The display apparatus of claim 11, wherein
the second photo-converter comprises a phosphor which absorbs the blue light and emits the second color light, or a quantum dot which absorbs the blue light and emits the second color light.

15. The display apparatus of claim 14, wherein
the second photo-converter comprises the quantum dot, and
a light emission spectrum of the quantum dot has a peak in an area corresponding to the yellow color light.

16. A display apparatus comprising:
a display panel comprising a plurality of pixels; and
a backlight unit disposed at a rear surface of the display panel and which provides light to the display panel, wherein
the backlight unit comprises:
a first light source which provides a first color light to the display panel;
a second light source which provides a second color light to the display panel; and
a third light source which provides a third color light to the display panel,
spectral bands of the first, second and third color light are different from each other, and
the first color light and the second color light have substantially the same color as each other,
wherein the first color light, the second color light, and the third color light are provided to the display panel in rotation.

* * * * *